United States Patent [19]

Goodwin

[11] 4,200,280

[45] Apr. 29, 1980

[54] WEIGHT LIFTING TYPE EXERCISING DEVICE

[75] Inventor: Max E. Goodwin, Valencia, Calif.

[73] Assignee: Marcy Gymnasium Equipment Company, Glendale, Calif.

[21] Appl. No.: 954,662

[22] Filed: Oct. 25, 1978

Related U.S. Application Data

[63] Continuation-in-part of Ser. No. 739,960, Nov. 8, 1976, abandoned.

[51] Int. Cl.[2] ..... A63B 21/06

[52] U.S. Cl. ..... 272/118; 403/330; 403/327; 272/DIG. 4

[58] Field of Search ..... 272/118, 121, 134, 117, 272/144, DIG. 4; 403/330, 327; 81/177 A; 172/275

[56] References Cited

U.S. PATENT DOCUMENTS

| | | | |
|---|---|---|---|
| Re. 28,066 | 7/1974 | Marcyan | 272/118 |
| 593,190 | 11/1897 | Bernhardt | 403/327 X |
| 3,526,040 | 9/1970 | Young | 403/330 X |
| 3,635,472 | 1/1972 | Marcyan | 272/118 |
| 3,971,555 | 7/1976 | Mahnke | 272/118 |

*Primary Examiner*—William R. Browne
*Attorney, Agent, or Firm*—James E. Brunton

[57] ABSTRACT

An exercising machine having vertical tracks, a vertically reciprocative carriage guide by the tracks, weights to bias the carriage downwardly and a lifting arm removably connected to the carriage, and having a failsafe mechanism for automatically interlocking the lifting arm and the carriage to prevent accidental decoupling thereof.

10 Claims, 5 Drawing Figures

WEIGHT LIFTING TYPE EXERCISING DEVICE

This is a continuation in part of my presently copending application Ser. No. 739,960 filed Nov. 8, 1976, now abandoned, entitled WEIGHT LIFTING TYPE EXERCISING DEVICE.

BACKGROUND OF THE INVENTION

1. Field of the Invention

This invention relates generally to exercising apparatus and more particularly to a unique safety improvement in exercising machines of the type wherein the body-engaging means or lifting arm is telescopically interconnected with a downwardly biased vertically reciprocative carriage.

2. Discussion of the Prior Art

In exercising machines of the type described in U.S. Pat. Nos. 3,635,472 and 3,971,555, there is provided an upright supporting structure having vertical track means, a vertically reciprocative carriage guided by the track means, weight means connected to the carriage to bias it downwardly and body-engaging means in the form of a lifting arm which is releasably interconnected to the carriage. In these devices, to accomodate different lifting arm starting heights the carriage is provided with a plurality of vertically spaced apart sockets adapted to telescopically receive a socket-engaging portion formed on the lifting arm. The lifting arm itself comprises, in addition to the socket-engaging portion, handle portions forming a "V" with the socket-engaging portion. The handle portions lie in a plane above the plane in which the socket-engaging portion is disposed. The lifting arm thusly configured coacts with the vertically spaced sockets to provide a plurality of starting heights. Additionally, by inverting the lifting arm so that the handle portions lie in a plane below that of the socket-engaging portion, further adjustment in vertical starting height is possible.

In the machines described in the aforementioned patents, as well as in various other similar types of machines, the lifting arm is typically locked against accidental removal from the sockets by means of a removable pin which extends through the socket and the socket-engaging portion of the lifting arm. This arrangement has proved disadvantageous for several reasons. For example, in practice the user of the apparatus may lose the pin or neglect or forget to insert it into the socket after the lifting arm is inserted. Additionally, the locking pin may become worn through use and become susceptible to failure under load. If the pin fails or is not properly in place, when the carriage is lifted the lifting arm may accidentally slip from the socket, causing severe injury to the user of the machine.

The unique safety latching device of the present invention overcomes the aforementioned drawbacks of the pin lock arrangement by providing a failsafe mechanism for automatically interlocking the lifting arm and the carriage upon insertion of the lifting arm into the carriage socket. The latching mechanism of the present invention is integral with the lifting arm so that it cannot be lost. It is structurally extremely sturdy so that it will not fail during use. Additionally, it is constructed so as to automatically and positively fall into locking engagement with the carriage by force of gravity upon insertion of the lifting arm into position relative to the carriage.

SUMMARY OF THE INVENTION

It is an object of the present invention to provide an improvement for exercising machines of the type embodying a downwardly biased vertically reciprocative carriage having a removable lifting arm telescopically interconnected thereto, the improvement consisting in providing a lifting arm which embodies a unique safety latching mechanism which enables the lifting arm to be automatically and positively coupled with the carriage in a manner as to preclude accidental decoupling thereof.

It is another object of the invention to provide an improvement of the aforementioned character in which the latching mechanism of the device is integrally connected to the lifting arm so that it cannot be misplaced, lost, or separated therefrom.

It is still another object of the invention to provide an improvement of the type described in the preceding paragraphs in which the latching mechanism of the device embodies a minimum number of parts, is highly reliable in operation, and, being gravity operated, does not rely for failsafe operation upon springs or other elements which are prone to failure during continuous use.

It is another object of the invention to provide an improvement of the class described in which the safety latching mechanism is extraordinarily strong and durable so as to preclude failure and an accidental decoupling of the lifting arm from the carriage even under extreme conditions of use.

It is still another object of the invention to provide an improvement of the aforementioned character which is of simple construction and is easy and inexpensive to manufacture.

In summary, these and other objects of the invention are realized by an improvement in an exercising device of the type having an upright supporting structure, vertical tracks associated with the upright supporting structure, a carriage which slides vertically upwardly and downwardly on the vertical tracks, the carriage being provided with a plurality of vertically spaced sockets, body-engaging means removably connected to the carriage at any selected one of the vertically spaced sockets, and adjustable resistance means associated with the carriage to bias the carriage and body-engaging means in a vertically downward direction, the improvement which consists of a body-engaging means comprising a lifting arm having a socket-engaging portion telescopically receivable within the vertically spaced sockets and a safety latching means carried by the socket-engaging portion and movable automatically into latching engagement with the carriage upon insertion of the socket engaging portion into the socket for locking the lifting arm against accidental withdrawl from the socket.

DESCRIPTION OF THE PREFERRED EMBODIMENTS

Figure 1:
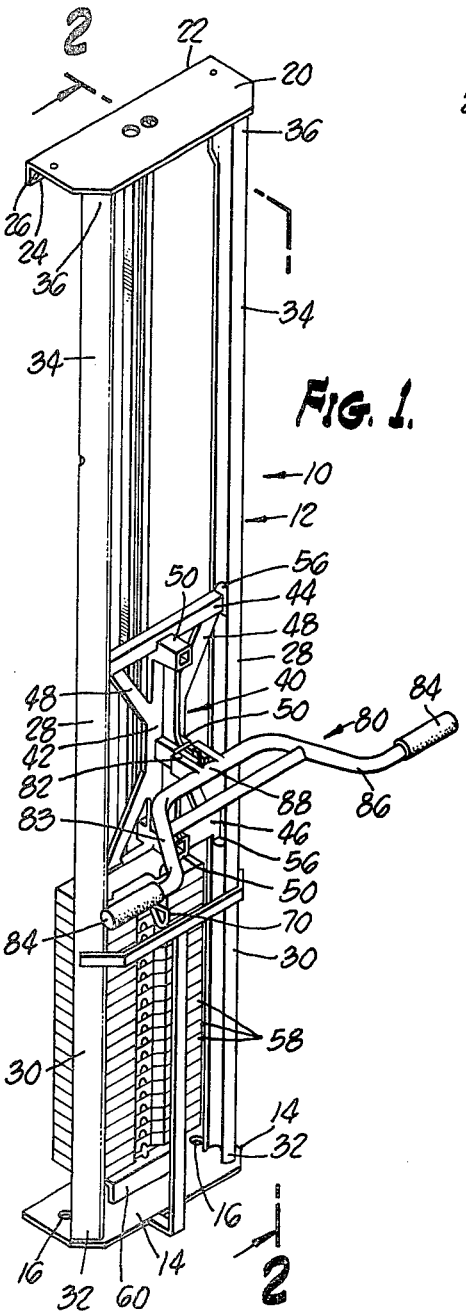
FIG. 1 is a perspective view of the improved machine of the present invention

Referring to the drawings and particularly to FIG. 1, the present improved exercising machine, designated by the numeral 10, comprises an upright supporting structure 12, which includes a lower plate 14 provided with a multiplicity of apertures 16 for attaching the unit to a floor or other support.

Upright supporting structure 12 also comprises an upper plate 20 including a back edge 22 having a downwardly projecting lip portion 24 provided with a multiplicity of apertures 26 for attachment to a wall or other support.

Also forming a part of upright supporting structure 12 is a pair of upright guide or track members 29, each having a lower portion 30 including an end 32 adapted to be attached as by welding to lower plate 14 at the location shown in FIG. 1. Members 28 also have an upper portion 34 and an end 36 which is attached as by welding to upper plate 20 at the locations shown.

Figure 2:
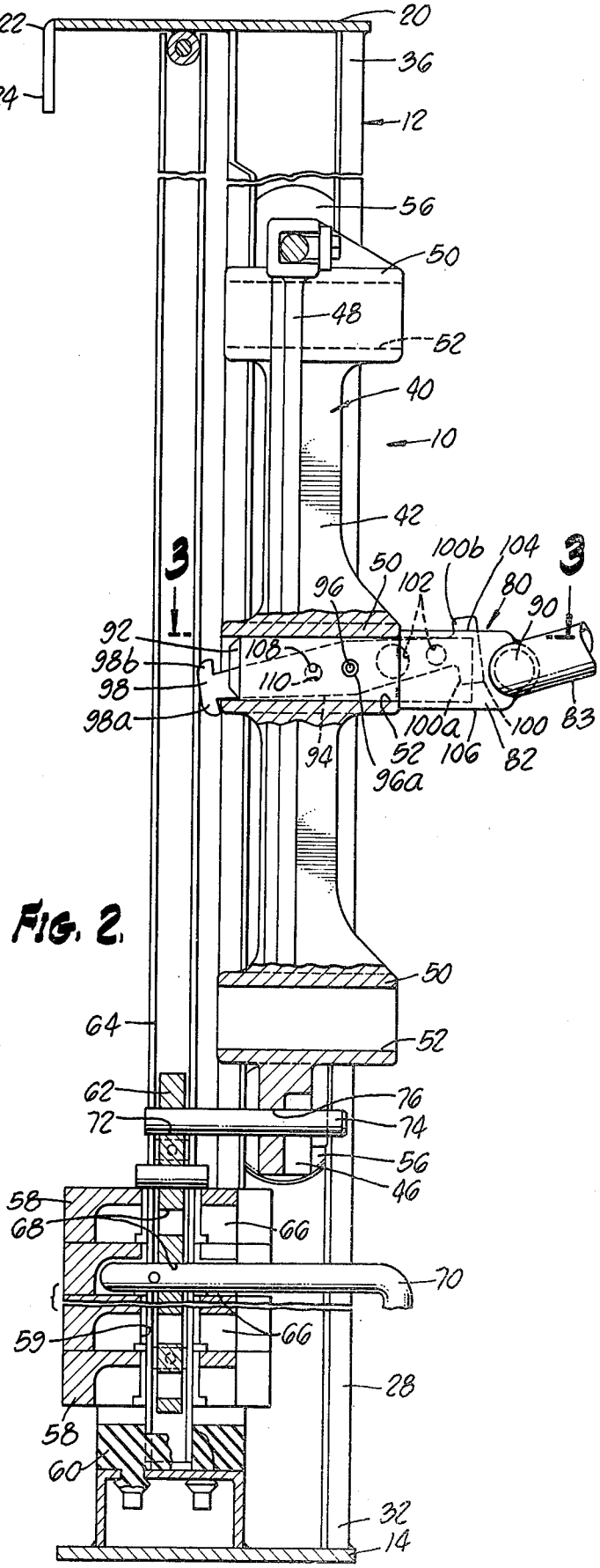
FIG. 2 is a mostly cross-sectional and enlarged foreshortened view of the machine of FIG. 1 taken along line 2—2 of FIG. 1.

Referring also to FIG. 2, machine 10 can be seen to include a vertically reciprocative carriage which is generally designated 40. As best seen in FIG. 1, carriage 40 includes a superstructure 42 made up of spaced apart upper and lower transverse members 44 and 46 and cross-members 48. Affixed to the forward face of superstructure 42 are vertically spaced apart sockets 50 projecting forwardly of the carriage with each having a central bore 52 extending therethrough. The purpose of sockets 50 will be discussed in detail hereinafter.

Mounted for rotation at each end of transverse members 44 and 46 are wheels 56 which are adapted to mate with and roll smoothly along tracks 28 as carriage 40 is moved vertically.

Machine 10 also includes an adjustable resistance means comprising a series of weights 58 stacked on top of one another, the bottom one resting on a base pad 60 carried by bottom plate 14. Each weight is provided with a vertical aperture 59 extending therethrough for the accommodation of a vertically disposed selector bar 62 and its guide rods 64, the purpose of which will presently be discussed. Each weight also has an aperture 66 at right angles to the first mentioned aperture and in horizontal alignment with apertures 68 provided in selector bar 62. Thus each one of the apertures 66 is aligned with an aperture 68 and a pin 70 can be inserted therethrough so that only the weights above the pin, including the one containing the pin, will be interconnected with the selector bar.

Selector bar 62 functions to interconnect the carriage 40 and the resistance means and is provided with an aperture 72 proximate its upper end for receiving a pin 74. Pin 74, in turn, is receivable in an aperture 76 provided proximate the lower edge of superstructure 42 of carriage 40. Thus, when pin 74 is in place within aperture 72 of the selector bar and aperture 76 of the carriage superstructure, the carriage and selector bar are operably interconnected.

Referring particularly to FIGS. 1 and 2, the novel body-engaging means or lifting arm of the device, which means comprises the improvement of the present invention, is designated by the numeral 80. The lifting arm comprises the socket-engaging portion 82 and the body-engaging portions 83. The socket-engaging portion is adapted to be telescopically receivable into the bore 52 of a selected socket 50 of the carriage 40. The body-engaging portions consist of horizontal coaxial handles 84 and shoulder-engaging portions 86 forming a "V". Portions 86 extend outwardly from their apex 88 to provide space to accommodate the head and neck of the user. The apex 88 is rigidly attached to the outer portion of the socket-engaging portion 82 so that the handles 84 lie in a plane above the plane in which the socket-engaging portion lies. Thus the lifting arm 80 is bent as indicated at 90 (FIG. 2). The bent lifting arm coacts with the plurality of sockets 50 to provide a plurality of starting heights to, in turn, permit accomplishment of a plurality of exercises. For example, if a man of medium height desired to perform a supine press, he would insert the free end 92 of the lifting arm in the lowest socket with the handles downward. Likewise, if a man of medium height desired to perform a sitting press, he would insert the end 92 of the lifting arm in center socket with the handles 84 upward. Similarly, if a man of medium height desired to perform an upright row, he would insert the end 92 of the lifting arm in the center socket with the handles downward. Likewise, if a man of medium height desired to perform a standing press, he would insert the end 92 of the lifting arm in the uppermost socket with the handles 84 upward.

In order to prevent the accidental withdrawal of the lifting arm from the selected socket 50 of the carriage 40, there is provided a novel safety latching means carried by the socket-engaging portion 82 of the lifting arm. As will be more fully discussed hereinafter, the safety latching means is movable into automatic latching engagement with the carriage upon insertion of the socket-engaging portion of the lifting arm into the selected socket.

Figure 3:
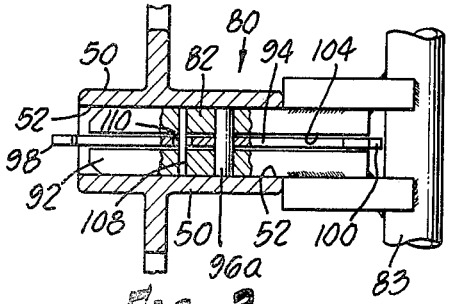
FIG. 3 is a partially cross-sectional view taken along lines 3—3 of FIG. 2.

Turning to FIGS. 2 and 3, the socket-engaging portion 82 of the lifting arm 80 can be seen to be of a hollow construction open at the free end 92. In the form of the invention shown in the drawings, the safety latching means comprises an elongated member 94 mounted for pivotal movement within the socket-engaging portion about a transversely extending substantially horizontally disposed axis 96 defined by a pin 96*a* carried by the lifting arm. Elongated member 94 comprises first and second hooked end portions 98 and 100 respectively disposed on opposite sides of axis 96. As best seen in FIG. 2, each end portion has outwardly extending oppositely disposed carriage interengaging means or arms 98*a* and 98*b* and 100*a* and 100*b* respectively.

One of the end portions of member 94, in this case end portion 98, is of greater weight than the other end portion so that it is constantly urged downwardly as viewed in FIG. 2 by the force of gravity. To achieve end portions of unequal weight, member 94 may be provided with a plurality of weight reduction openings such as openings 102. Additionally, if desired, ballast may be added to one end of the member 94.

As illustrated in the drawings, member 94 is so constructed and arranged that end portion 98 protrudes from the open free end 92 of the socket-engaging portion of the lifting arm. When the lifting arm is in place within a socket 50 in the manner shown in FIG. 2, the interengaging means or arm 98*a* engages the rear face of socket 50 and acts as a locking element to prevent withdrawal of the lifting arm from the socket.

Provided intermediate the ends of socket-engaging portion 80 and located to the right of axis 96 (FIG. 2) is at least one aperture or slotted portion 104 so constructed and arranged as to receive therethrough arm 100*b* of the second end of member 94 when the member is in an at-rest position. In the embodiment of the invention shown in FIG. 2, socket-engaging portion 82 is also provided with a second aperture or slotted portion 106 disposed directly below aperture 104. Aperture 106 is so constructed and arranged as to receive arm 100*a* of member 94 when the member is pivoted about axis 96 in a clockwise direction as viewed in FIG. 2. To limit the extent of pivotal movement of member 94, there is provided a transversely extending limit pin 108. Pin 108 is carried by the lifting arm and is located intermediate end 92 and the pivotal axis 96. Pin 108 extends through an aperture 110 formed in member 94 which aperture is of larger diameter than limit pin 108, thereby limiting the extent to which member 94 can pivot about axis 96.

Operation

In operation, the trainee first decides how much weight he desires to lift and sets pin 70 into a selected aperture 66 in the series of adjustable weights 58. Apertures 66 have already been aligned with apertures 68 of the selector bar so that pin 70 forms a joinder between the weights of the series and the selector bar when such a selection is made.

As previously mentioned, since the selector bar is interconnected to carriage 40 by means of pin 74, when the adjustable resistance means is connected to the selector bar, the carriage will be downwardly biased. Next, depending upon the exercise to be performed, the trainee inserts the free end of the lifting arm into one of the vertically spaced sockets 50 of the carriage.

Referring to FIG. 2, it can be seen that during insertion of the lifting arm into the socket, end 98 of pivotally mounted member 94 will slide along the inside wall of bore 52 formed in socket 50. Since end 98 is of greater weight than end 100, when the lifting arm is fully inserted into the socket, member 94 will pivot about axis 96 due to the force of gravity and arm 98*a* will fall into the position shown in FIG. 2 wherein it is in locking interengagement with the rear face of the socket 50 of the carriage. At the same time, end 100*b* will move into its upper position with arm 100*b* protruding through aperture 104 formed in the lifting arm. In this configuration, the locking arm is securely locked against accidental withdrawal from the socket.

With the lifting arm thus securely locked, upward forces generated on the lifting arm by the trainee will cause the carriage to move upwardly against the downward bias of the weights. The wheeled carriage is, of course, guided by the tracks and the selector bar is guided by the selector bar guides 64.

To decouple the lifting arm from the carriage, the trainee must positively push downwardly on arm 100*b* of member 94, causing the member to pivot about axis 96 to a centered position so as to raise end 98 to a position where arm 98*a* will clear the rear face of the socket. A rearward force generated on the lifting arm will then permit its withdrawal from the socket and its disconnection from the carriage.

It is to be appreciated that due to the novel construction of the safety latching means, it will operate in the manner described whether the lifting arm is inserted with the handle portions in an elevated or lowered plane relative to the plane of the socket-engaging portion. For example, if the lifting arm were to be inverted from the position shown in FIG. 2 so that portion 83 extended angularly downwardly rather than upwardly, upon insertion of the arm into a socket 50, locking arm 98*b* would fall into a downward locking position relative to the carriage and arm 100*a* would extend through aperture 106 which would then be disposed on the top of the lifting arm.

Figure 4:
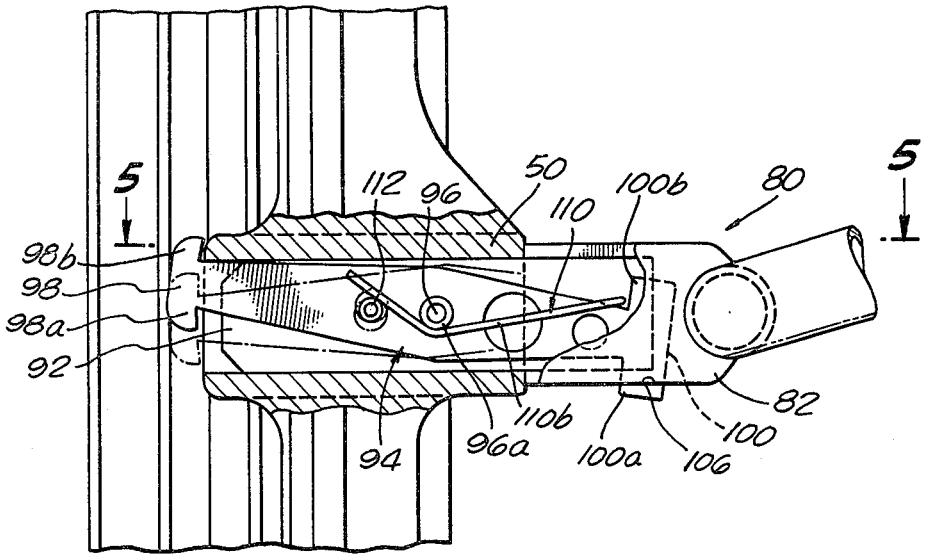
FIG. 4 is a fragmentary side elevational view, partly in section showing another form of safety latching means.
Figure 5:
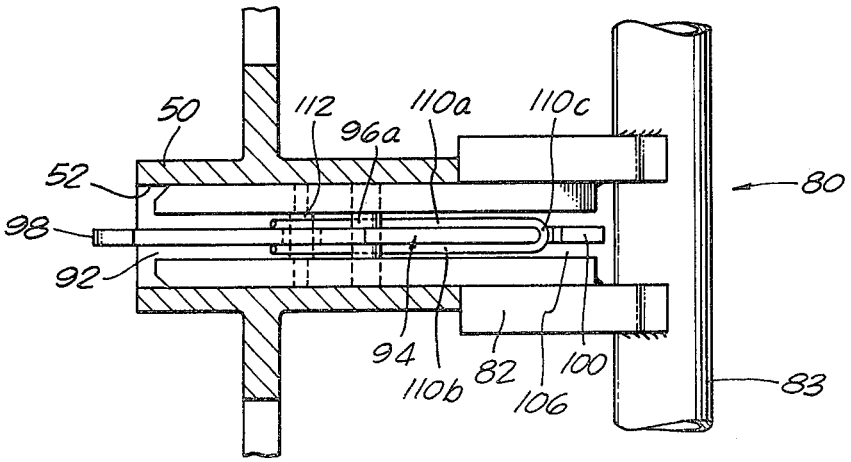
FIG. 5 is a partially cross-sectional view taken along lines 5—5 of FIG. 4.

Referring to FIGS. 4 and 5, there is shown another form of safety latching mechanism of the present invention. In this form of the invention the safety latching mechanism, like that shown in FIGS. 1 through 3, is carried within the hollow socket engaging portion 82 of lifting arm 80 (like numbers are used in FIGS. 4 and 5 to indicate previously identified like parts). The mechanism comprises an elongated member 94 mounted for pivotal movement within portion 82 about a transversely extending substantially horizontally disposed axis 96 defined by a pin 96*a* carried by the lifting arm.

As in the construction previously described, elongated member 94 has first and second hooked end portions 98 and 100 respectively disposed on opposite sides of axis 96. Each end portion comprises outwardly extending oppositely disposed carriage inter-engaging means or arms 98*a* and 98*b* and 100*a* and 100*b*. Member 94 is configured so that in operation end portion 98 protrudes from the open free end 92 of the socket engaging portion of the lifting arm. As shown in FIG. 4, portion 82 of lifting arm 80 is provided with an aperture 106 adapted to receive therethrough end 100*a* of member 94.

When the lifting arm is in place within the socket in the manner shown in FIG. 4, arm 100*a* extends through aperture 106 and arm 98*b* engages the rear face of socket and acts as a locking element to prevent withdrawl of the lifting arm from the socket.

In the embodiment of the invention illustrated in FIGS. 4 and 5, member 94 is releasably held in the locking position depicted by the solid lines in FIG. 4 by a biasing means provided in the form of a length of yieldably resilient wire. As best seen in FIG. 5, the length of resilient wire is bent to form a generally "U" shaped member 110 having first and second yieldably resilient leg portions 110*a* and 100*b*. Leg portions 110*a* and 110*b* are bent intermediate the bight portion 110*c* of the "U" shaped member and the free end portions of legs. When member 110 is in an operative position within the apparatus as shown in FIG. 5, legs 110*a* and 110*b* straddle member 94 with the bight portion thereof disposed in pressural engagement with the top wall of member 94. The free end portions of legs 110*a* and 110*b* are urged upwardly so that they rest upon the upper surface of a pin 112 which is carried by the lifting arm and is located intermediate end 92 of member 94 and the pivotal axis 96. With this arrangement resilient member 110 being under stress continuously urges end 100 of member 94 downwardly so that end portion 100*a* protrudes through aperture 106 and simultaneously urges end 98*b* into locking engagement with the rear face of the socket 50.

In this embodiment of the invention, when the trainee desires to decouple the lifting arm from the carriage he must positively push upwardly on arm 100*a* of member 94. This causes member 94 to pivot about axis 96 against the urging of the biasing means so as to lower end 98 to the position shown in the phantom lines of FIG. 4. In this position arm 98*b* will clear the face of the socket and the lifting arm can be withdrawn from the socket.

When the trainee wishes to insert the lifting arm into the socket he need merely push up on end 100*a* of element 94, insert the end of the lifting arm into the socket and push the lifting arm in a forwardly direction. When the lifting arm is fully inserted into the socket, the biasing means will automatically urge end 98*b* of member 94 into locking engagement with the rear surface of the socket and thereby prevent accidental withdrawl of the lifting arm during the performance of exercises on the apparatus.

Having now described the invention in detail in accordance with the requirements of the patent statutes, those skilled in this art will have no difficulty in making changes and modifications in the individual parts of their relative assembly in order to meet specific requirements or conditions. Such changes and modifications may be made without departing from the scope and spirit of the invention, as set forth in the following claims.

I claim:

1. In an exercising machine of the type having an upright supporting structure, vertical tracks associated with said upright supporting structure, a carriage which slides vertically upwardly and downwardly on said vertical tracks, said carriage being provided with a plurality of vertically spaced sockets, body-engaging means removably connected to the carriage at any selected one of said vertically spaced sockets, and adjustable resistance means associated with the carriage to bias the carriage and body-engaging means in a vertically downward direction, the improvement which consists of a body-engaging means comprising a lifting arm having:

(a) a socket-engaging portion having an open free end and telescopically receivable in substantially a horizontal direction within the vertically spaced sockets; and (b) a safety latching means carried by said socket-engaging portion and pivotally movable relative thereto about a transversely extending axis, said safety latching means having oppositely disposed first and second ends spaced on opposite sides of said axis, one of said ends being movable by force of gravity automatically into latching engagement with the carriage upon insertion of said socket-engaging portion into the socket for locking said lifting arm against movement relative to said socket in a reverse direction thereby preventing accidental withdrawl from the socket and the other of said ends being engageable to move said opposite end out of latching engagement with the carriage.

2. An improvement as defined in claim 1 in which said socket-engaging portion is hollow having an open free end and in which said safety latching means comprises an elongated member mounted for pivotal movement within said socket-engaging portion about said axis being a transversely extending substantially horizontally disposed axis, said first end protruding from the open free end of said socket-engaging portion and including carriage-engaging means for engaging said carriage when said member is in an at-rest position to prevent horizontal movement of said socket-engaging portion thereby precluding withdrawl of said socket engaging portion from said socket.

3. An improvement as defined in claim 2 in which one of said horizontally spaced apart ends is of greater weight than the other.

4. An improvement as defined in claim 2 in which said elongated member and comprises at least one outwardly extending hook shaped element adapted to engage the carriage.

5. An improvement as defined in claim 4 in which said socket-engaging portion is provided with at least one end receiving aperture disposed proximate said second end of said elongated member and adapted to receive therethrough the extremity of said second end of said elongated member when said hook shaped element is in engagement with the carriage.

6. In an exercising machine of the type having an upright supporting structure, vertical tracks associated with said upright supporting structure, a carriage which slides vertically upwardly and downwardly on said vertical tracks, said carriage being provided with a plurality of vertically spaced sockets, body-engaging means removably connected to the carriage at any selected one of said vertically spaced sockets, and adjustable resistance means associated with the carriage to bias the carriage and body-engaging means in a vertically downward direction, the improvement which consists of a body-engaging means comprising a lifting arm having:

(a) a hollow socket-engaging portion having an open free end telescopically receivable in substantially a horizontal direction within the vertically spaced sockets said socket-engaging portion having an aperture formed therein; and (b) a safety latching means carried by said socket-engaging portion and pivotally movable relative thereto about a transversely extending, substantially horizontal axis, said safety latching means having oppositely disposed first and second ends of different weight on opposite sides of said axis in substantially axial alignment, one of said ends being movable by force of gravity automatically into latching engagement with the carriage upon horizontal insertion of said socket-engaging portion into the socket for locking said lifting arm against movement relative to said socket in a reverse direction thereby preventing accidental withdrawl from the socket and the other of said ends being receivable in the aperture formed in said socket-engaging portion and being engageable to move said opposite end out of latching engagement with the carriage in response to a force exerted thereon.

7. In an exercising machine of the type having vertical tracks, a carriage which travels vertically upwardly and downwardly along said vertical tracks, said carriage being provided with at least two vertically spaced sockets, body-engaging means removably connected to the carriage at any selected one of said vertically spaced sockets, and adjustable resistance means associated with the carriage to bias the carriage and body-engaging means in a vertically downward direction, the improvement which consists of a body-engaging means comprising a lifting arm having:

(a) a hollow socket-engaging portion having an open free end telescopically receivable in substantially a horizontal direction within the vertically spaced sockets said socket-engaging portion having an aperture formed therein; and (b) a safety latching means carried by said socket-engaging portion and pivotally movable relative thereto about a transversely extending, substantially horizontal axis, said safety latching means having oppositely disposed first and second ends on opposite sides of said axis in substantially axial alignment, one of said ends being movable automatically into latching engagement with the carriage upon horizontal insertion of said socket-engaging portion into the socket for locking said lifting arm against movement relative to said socket in a reversing direction thereby preventing accidental withdrawl from the socket; and (c) biasing means for yieldably urging said one of said ends of said safety latching means into latching engagement with the carriage.

8. An exercising machine as defined in claim 7 in which said biasing means is adapted to yieldably urge the other of said ends of said safety latching means into said aperture formed in said socket-engaging portion, said other of said ends being engageable to move said opposite end out of latching engagement with the carriage in response to a force exerted thereon sufficient to overcome the urging of said biasing means.

9. An exercising machine as defined in claim 8 in which said biasing means comprises a length of yeildably resilient wire constructed and arranged to act upon said safety latching means to continuously yieldably urge said one of said ends thereof into latching engagement with the carriage.

10. An exercising machine as defined in claim 9 in which said length of wire is "U" shaped having first and second leg portions, disposed on opposite sides of said safety latching means and a bight portion disposed in pressural engagement with said safety latching means.

* * * * *